US007209094B1

(12) United States Patent
Hunter et al.

(10) Patent No.: US 7,209,094 B1
(45) Date of Patent: Apr. 24, 2007

(54) GENETICALLY OPTIMIZED DIGITAL IONOSPHERIC SOUNDING SYSTEM (DISS) TRANSMIT ANTENNA

(75) Inventors: James R. Hunter, Waltham, MA (US); Richard J. Barton, Arlington, MA (US); Teresa H. O'Donnell, Billerica, MA (US); Terence W. Bullett, Berthoud, CO (US); Steven R. Best, Townsend, MA (US)

(73) Assignee: United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 11/198,413

(22) Filed: Aug. 5, 2005

(51) Int. Cl.
*H01Q 9/34* (2006.01)

(52) U.S. Cl. ..... 343/874; 343/890; 364/512

(58) Field of Classification Search ..... 343/874, 343/877, 890, 891, 892
See application file for complete search history.

(56) References Cited

U.S. PATENT DOCUMENTS 3,588,904 A * 6/1971 Broyles ..... 343/792.5
3,696,430 A * 10/1972 Cory et al. ..... 343/792.5
5,319,380 A * 6/1994 Bruger ..... 343/813
6,567,049 B1 * 5/2003 Huang et al. ..... 343/700 MS
2002/0122003 A1 * 9/2002 Patwari et al. ..... 342/450

* cited by examiner

*Primary Examiner*—Tho Phan
(74) *Attorney, Agent, or Firm*—AFMCLO/JAZ; William G. Auton

(57) ABSTRACT

The Genetically Optimized Digital Ionospheric Sounding System (DISS) Transmit Antenna is a low-cost modification to the TCI 613F HF communications antenna that increases and stabilizes vertical gain from 4 to 30 MHz. Genetic algorithm and local search techniques were used in the design of the modification in order to take into account both electrical design and mechanical simplicity in this design. The novelty lies in the specific placement of conducting wires with respect to the original TCI antenna. This placement both increases the vertical gain of the antenna as a whole and adds to its stability as each wire also acts as a guy cable.

1 Claim, 9 Drawing Sheets

TCI-631F antenna model and performance graphs

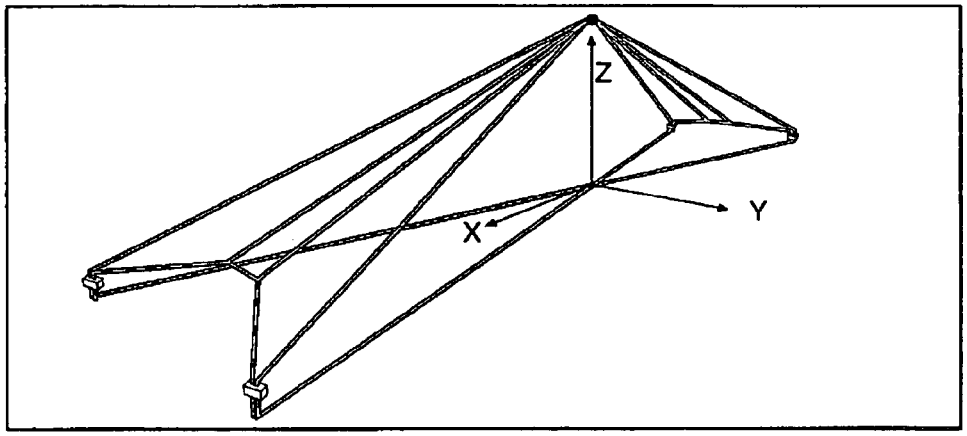
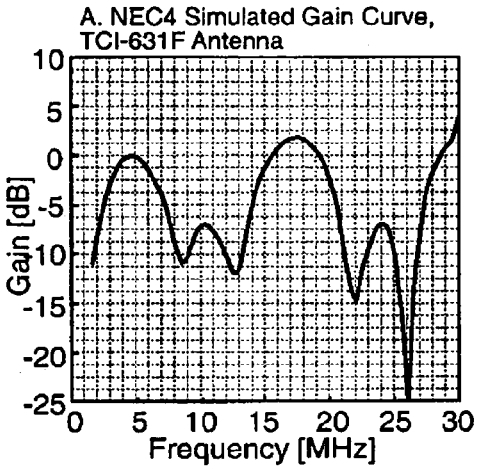
*Fig. 1A*
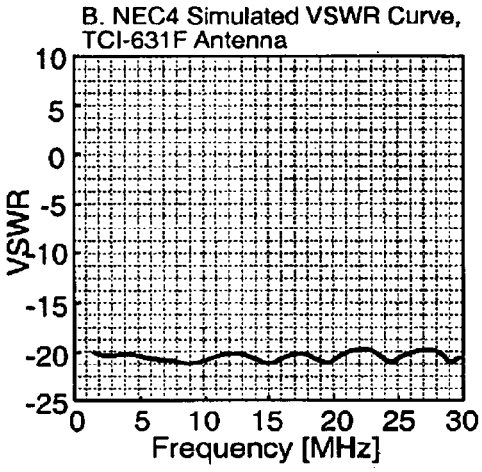
*Fig. 1B*
*Fig. 1*
TCI-631F antenna model and performance graphs
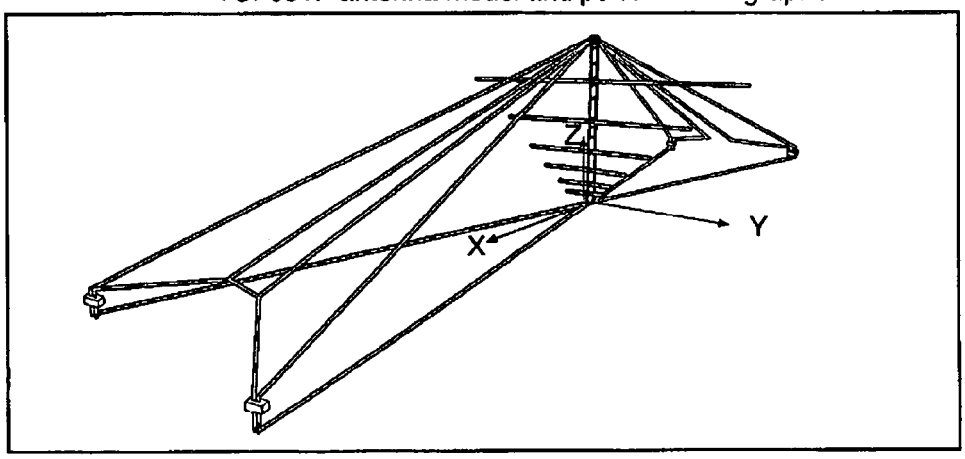
*Fig. 2* TCI-631F antenna model with LPDA augmentation

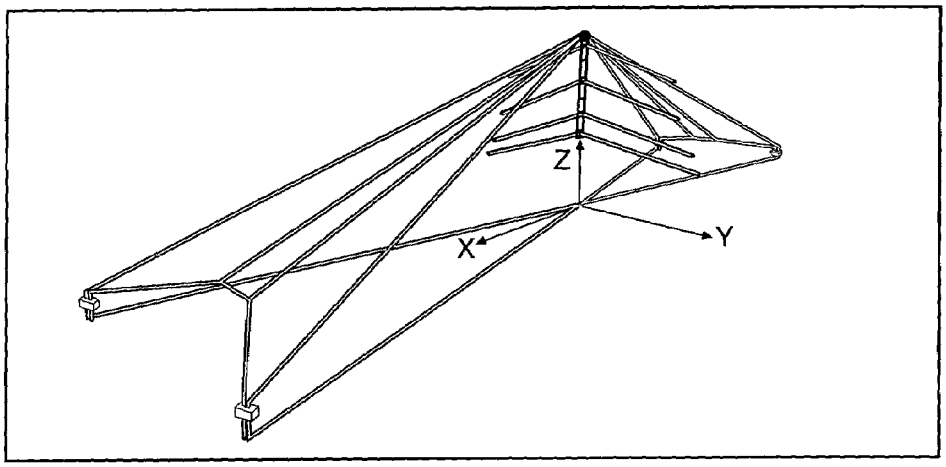
Fig. 5 GA Hybrid antenna model
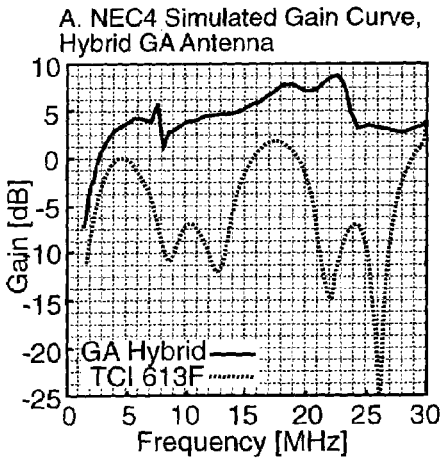
Fig. 5A
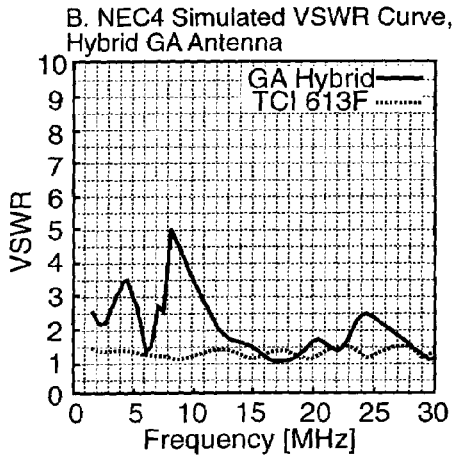
Fig. 5B

GENETICALLY OPTIMIZED DIGITAL IONOSPHERIC SOUNDING SYSTEM (DISS) TRANSMIT ANTENNA

STATEMENT OF GOVERNMENT INTEREST

The invention described herein may be manufactured and used by or for the Government for governmental purposes without the payment of any royalty thereon.

BACKGROUND OF THE INVENTION

The invention relates generally to antenna design, and more specifically, it relates to a genetically optimized DISS transmit antenna. Ionospheric measurements provide crucial information to Air Force systems and warfighters about the accuracy and reliability of our sensor and communication systems. The ionosphere is the ionized portion of the Earth's upper atmosphere that extends from approximately 60 to 1000 km altitude. All radio frequency signals propagating through this region are influenced by the ionosphere, and the resulting impact to the communications capabilities of civilian and military systems ranges from negligible to severe depending on frequency.

Characterization of the ionospheric environment is therefore key to situational awareness, mitigation of degrading impacts on U.S. military operations and exploitation of enemy susceptibilities. Combatant Commanders, as well as operational and tactical units, use ionospheric analyses and predictions for diagnosing and avoiding errors and outages in communications, radars, and Precision Navigation & Timing (PNT) systems such as GPS.

Relevant prior art includes the following U.S. patents, the disclosures of which are incorporated herein by reference:

U.S. Pat. No. 5,289,198 issued to Altshuler;

U.S. Pat. No. 5,719,794 issued to Altshuler;

U.S. Pat. No. 5,361,403 issued to Sent;

U.S. Pat. No. 5,224,056 issued to Chene et al;

U.S. Pat. No. 5,394,509 issued to Winston; and

U.S. Pat. No. 5,390,282 issue to Hopkins.

U.S. Pat. No. 5,719,794 issued to Altshuler is for a process for the design of antennas using genetic algorithms and its technology was used in the development of the present invention.

Ionosondes in general, and the Digital Ionospheric Sounding System (DISS) network in particular, are key elements in the DoD ionospheric sensing strategy. The DISS network is operated by US Air Force Weather Agency (AFWA) and the Air Force Research Laboratory (AFRL) Battlespace Environment Division (VSB) in order to observe and specify the global ionosphere in real time. There are 18 fully automated digital ionosondes deployed by the Air Force worldwide that provide data for many products, including: specification and forecasts of primary and secondary HF radio propagation characteristics; ionospheric electron density and total electron content; ionospheric scintillation; environmental conditions for spacecraft anomalies; and sunspot number.

A need remains for an off-the-shelf TCI model 613F communications antenna that transmits radio signals of different frequencies across a specified sweep (between 1 and 30 MHz) in a vertical direction, which are reflected, absorbed, or distorted by the ionosphere. Receive antennas then intercept the returning signals for processing by various analysis algorithms.

The present invention is intended to satisfy that need.

SUMMARY OF THE INVENTION

The Genetically Optimized Digital Ionospheric Sounding System (DISS) Transmit Antenna is a low-cost modification to the TCI-613F HF communications antenna that increases and stabilizes vertical gain from 4 to 30 MHz. Genetic algorithm and local search techniques were used in the design of the modification in order to take into account both electrical design and mechanical simplicity in the design. The novelty lies in the specific placement of conducting wires with respect to the original TCI antenna. This placement both increases the vertical gain of the antenna as a whole and adds to its stability as each wire also acts as a guy cable.

DESCRIPTION OF THE DRAWINGS

FIG. 1 is a view of the genetically optimized DISS transmit antenna;

FIGS. 1A and 1B are charts of antenna performance characteristics;

FIG. 2 is an antenna with LPDA modifications;

FIG. 5 is a view of the hybrid antenna;

FIGS. 5A and 5B are charts of antenna performance;

DETAILED DESCRIPTION OF THE PREFERED EMBODIMENT

Figure 3:
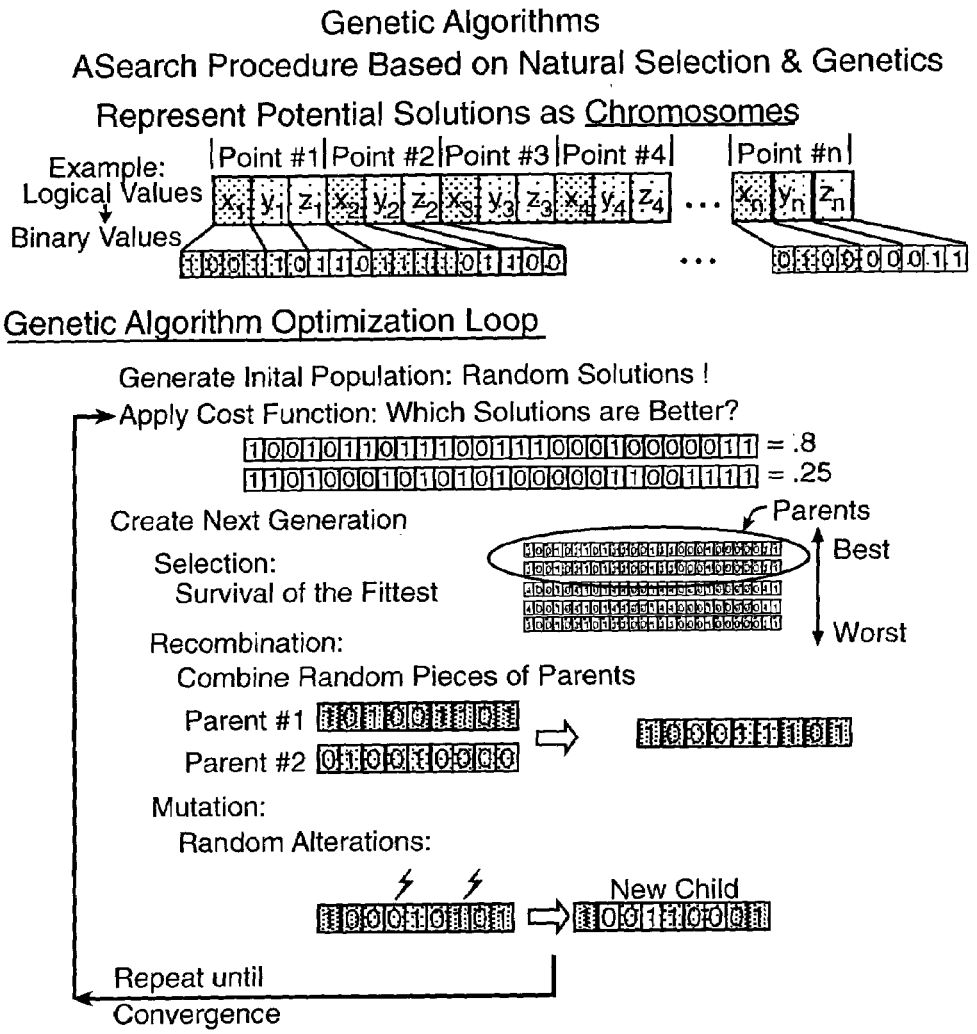
FIG. 3 is a genetic algorithm process for antenna design.

The Genetically Optimized DISS Transmit Antenna is used by AFRL and AFWA to increase the sensor performance of the global Digital Ionospheric Sounding System. The system makes 1 to 30 MHz scans of the ionosphere in order to determine ionospheric effects on radio communication. The original transmit antenna's gaps in vertical gain from 5 to 15 MHz and 20 to 27 MHz that cause weak scans at those frequencies resulting in subsequently poor sensor performance. The Genetically Optimized Digital Ionospheric Sounding System Transmit Antenna solves that performance issue, improving gain in deficient regions by as much as 10 times, and decreasing error rates by an order of magnitude.

The reader's attention is directed towards FIG. 1 which is a top view of a standard TCI-613F communications antenna that, when used as an ionosonde's transmit antenna, transmits radio signals of different frequencies across a specified sweep (between 1 and 30 MHz) in a vertical direction, which are reflected, absorbed, or distorted by the ionosphere. Receive antennas then intercept the returning signals for processing by various analysis algorithms.

However, the TCI-613F was designed for high frequency (HF) band communications, and not for ionospheric measurements. As simulated in Numerical Electromagnetics Code version 4 (NEC4), the antenna does not exhibit a consistent gain in the vertical direction for all desired frequencies (FIG. 1A), and in fact has inadequate vertical gain of less than 0 dB over most of the HF band. This loss is mostly caused by electromagnetic energy being radiated sideways, as is desired in certain HF communications scenarios, instead of upwards, which is desired for an ionosonde. A second measure of antenna performance, the voltage standing wave ratio (VSWR) (FIG. 1B), which is a ratio of provided power to actual transmitted power, is excellent across the entire frequency band.

The low vertical gain allows interference from other sources (i.e. radio stations, radar, etc.) to overwhelm the reflected signals from the DISS, which leads to false ionospheric echoes or missing echoes, and subsequently poor analysis results. Hence, both AFWA and AFRL VSB sought a simple, low-cost antenna design to correct the problem and provide improved ionospheric measurements while avoiding the costs of complete antenna replacement.

Initially, AFRL VSB considered a log periodic dipole array (LPDA) augmentation to increase the TCI antenna's performance (FIG. 2). Electrically, the LPDA greatly increased performance across the frequency band with only a minor increase in VSWR; however constructing the modification proved to be extremely difficult and time consuming, not to mention unsafe. During construction operations in 2003 at the Ascension Island DISS site, the LPDA collapsed under its own weight during high winds, almost injuring the construction crew. The long horizontal dipoles proved to be mechanically unstable. Correcting instability would take as much or more labor, materials and time as replacing the entire antenna. This led VSB engineers to seek out a better, more customized solution that took into account more than electrical performance. Fortunately, their neighbors at Hanscom AFB, the AFRL Electromagnetics Technology Division (SNH), part of Sensors Directorate, had a method for designing such a solution through their experience in genetic antenna design and optimization.

Genetic algorithm (GA) optimization is a robust, stochastic search method modeled on the principles and concepts of natural selection and evolution. GA's are well suited for solving complex problems of many parameters, making them ideal for intricate antenna design where performance is caused by the complex three dimensional electromagnetic interactions of large numbers of radiating structures.

During genetic optimization (FIG. 3), possible solutions to a problem are represented as chromosomes, usually strings of real or binary values. The elements of a chromosome represent the parameters of one potential problem solution. An initial population of random solutions is created and then evaluated, according to a cost function. Evaluation is performed by constructing each of the potential problem solutions and then comparing how well they meet the desired criteria via the cost function. Some chromosomes will naturally perform better than others and these are given a better chance of being selected as parents of the next generation. The children of the next generation are created during recombination operations, in which pieces (i.e. parameters) of one parent solution are combined with pieces from one or more different parents to create a new solution which incorporates some qualities of each. A third genetic operator, mutation, acts to randomly modify parameters in a child solution; this allows for new parameters to be explored which are not necessarily represented in either parent.

The simple operations of selection, recombination, and mutation act to combine pieces of salient information (called schema) from multiple "good" parent solutions together. Through recombination, good schema representing different parts of a good solution have the chance of occurring simultaneously within the same chromosome to create an even better solution. Mutations allow for small changes to occur in the schema and new genetic material to be introduced which may not be present in the initial population. However, there are many potential pitfalls in applying the simple genetic algorithm to a problem, and often pre-convergence and stagnation into a non-optimal local minima occur if the relationship between the problem and the chromosome encoding is not well understood.

Figure 4:
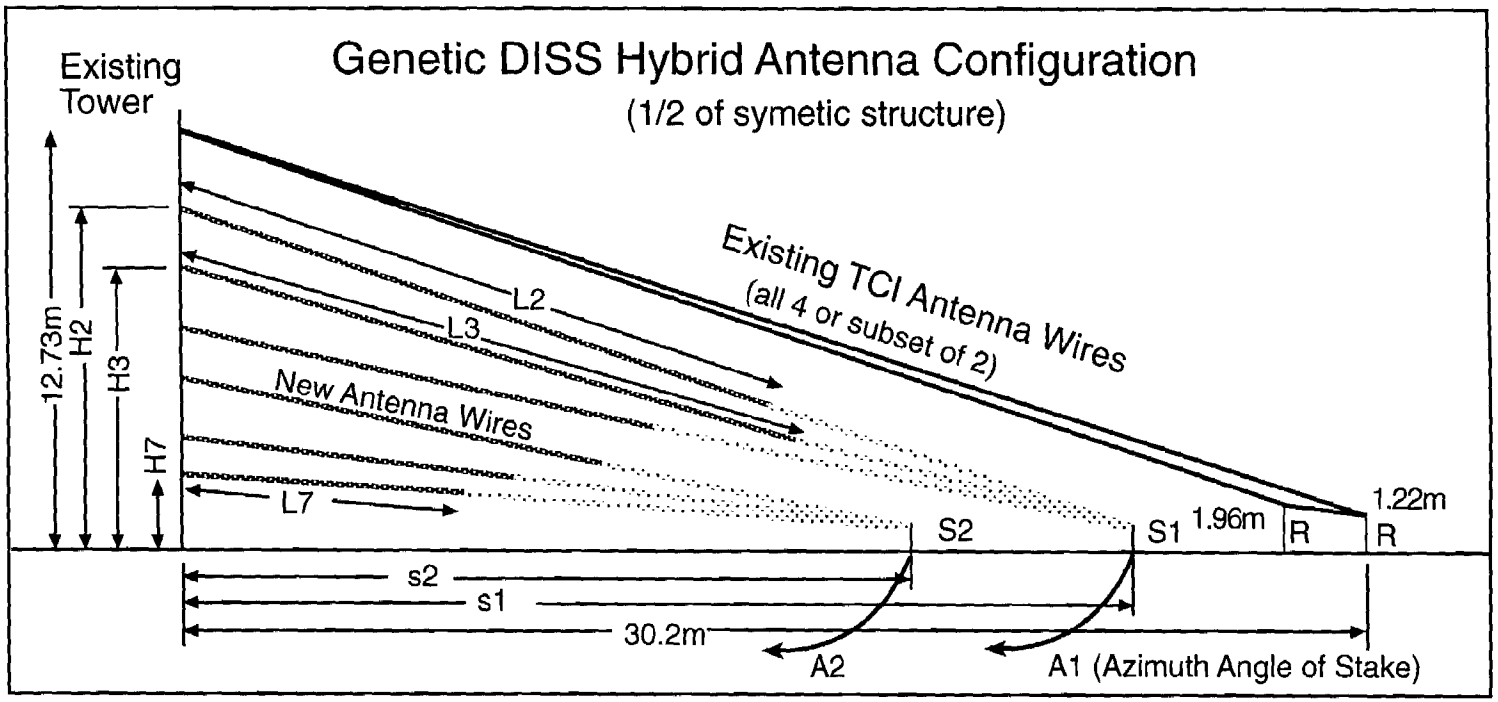
FIG. 4 is a view of the antenna with LPDA augmentations with the dimensions.

The two AFRL groups combined their in-house skills and talents to propose and develop a new improved DISS antenna. Since the LPDA design had proven electromagnetically successful although mechanically unstable, the SNH and VSB antenna design team decided to add a number of wires, bent towards the ground, rather than straight pieces of waveguide, to the TCI structure. These new wires could be anchored directly to ground or to the TCI curtain, which would eliminate the complex guying schemes and rigid structural members of the LPDA, replacing them with simple tensioned cable lengths. It was unclear whether the new wires should be fed in an alternating-phase pattern, like an LPDA, or whether the more simple dipole array feed mechanism would suffice (which it did). It also seemed prudent to let the genetic algorithm optimize at what angle the new wires should be added and whether the load resistors of the TCI would need to be modified for the new combined antenna structure. These elements, along with the wire active lengths and heights, were represented in the chromosome as parameters to be optimized by the genetic algorithm (FIG. 4). The cost function consisted of a weighted combination which achieved the best vertical radiated power gain across the frequency sweep while maintaining a low, well-behaved VSWR.

After several months of optimization, returning the antenna representations, testing construction techniques, and accounting for unforseen electrical and logistic considerations, the AFRL team and genetic algorithm reached the antenna solution shown in FIG. 5. Besides optimizing the wire lengths, the GA also modified the overall antenna design by optimizing some proposed wires to zero-length and eliminating them. The final simplified design, consisting of eight wires suspended between the existing TCI antenna tower and two ground stakes, met the electrical requirements of positive gain across the DISS' frequency band and mechanical requirements of stability and ease of construction. In simulation, the antenna performed superbly with gain improvement at all frequencies (FIG. 5A), with only a minor VSWR spike at a single frequency (FIG. B). Note that FIG. 5 only shows the conducting portion of the added wires, and not the non-conducting portion that connects the free end of the wires to the ground stakes.

Figure 6:
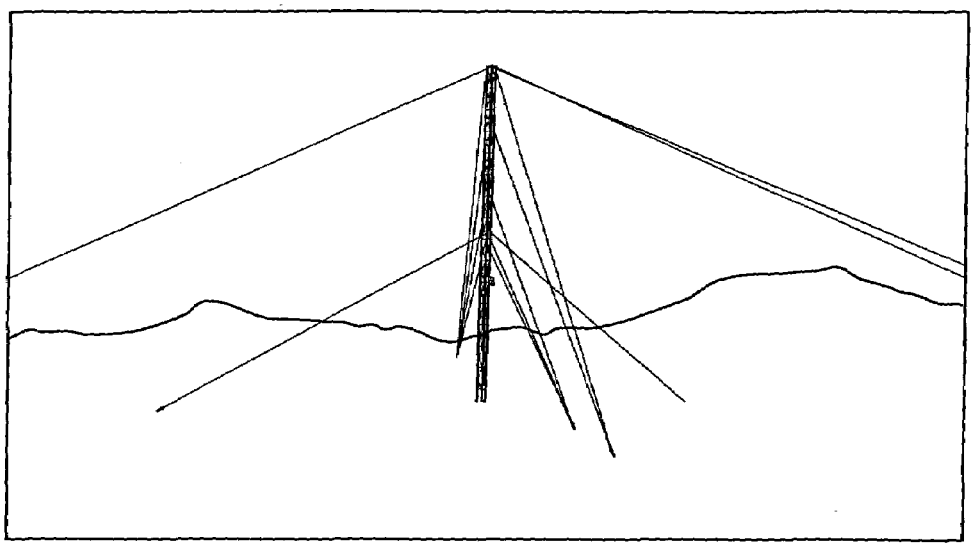
FIG. 6 is another hybrid antenna.

The next step was to permanently deploy the optimized modification at the Ascension Island DISS in the South Atlantic where previous measurements have shown that the local ionosphere supports reflections up to 20 MHz. In addition, high powered transmitters located nearby seriously degraded its performance by overpowering the DISS' signals. Ten hours of labor by two installers and less than $500 worth of supplies was all it took to complete the GA Hybrid modification (FIG. 6). This is compared to three days and $1000 worth of supplies for the failed LPDA installations, and two weeks and $30,000 required for a complete antenna replacement. The design also proved to be highly stable, acting as additional guying between the tower and the ground.

Figure 6A:
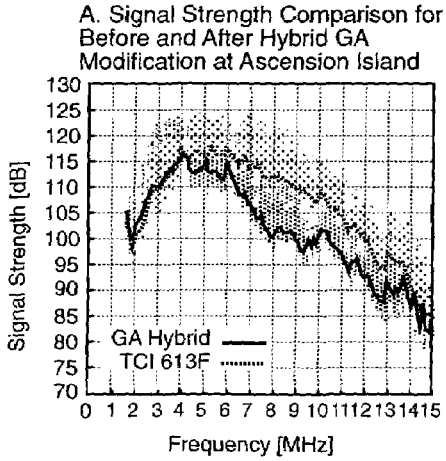
FIGS. 6A and 6B are charts of antenna performance.
Figure 6B:
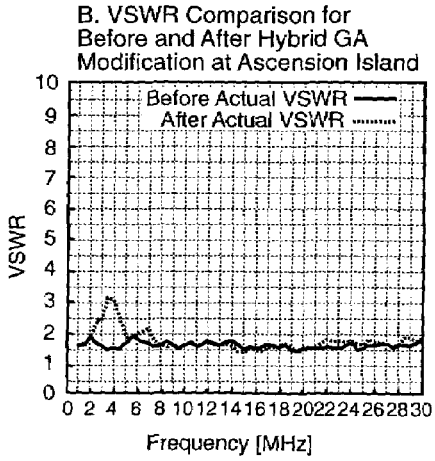
Figure 7A:
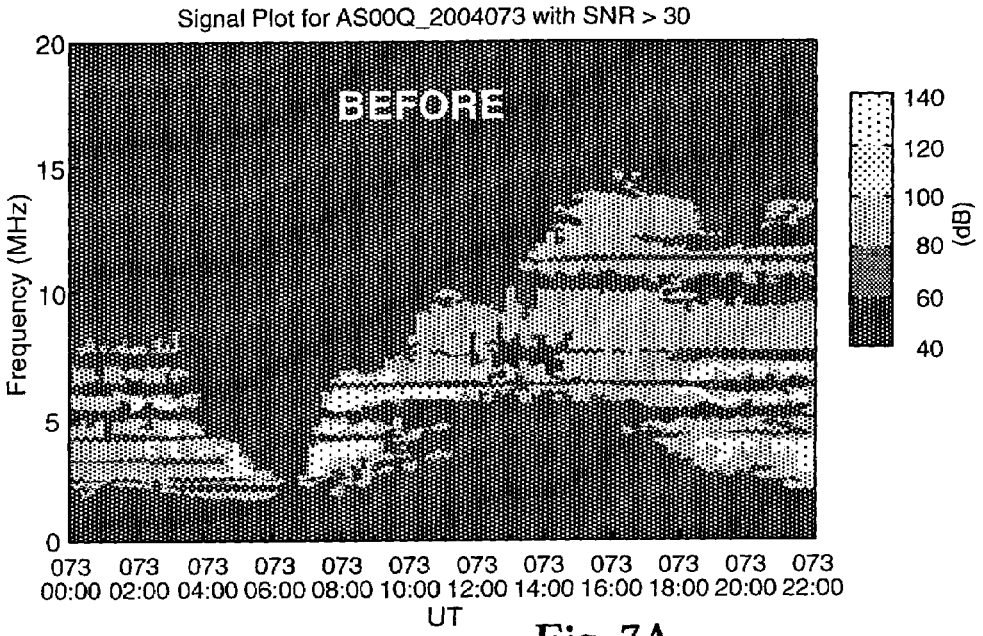
FIGS. 7A–7B and FIGS. 8–10 are different views of the optimized DISS transmit antenna of the present invention.
Figure 7B:
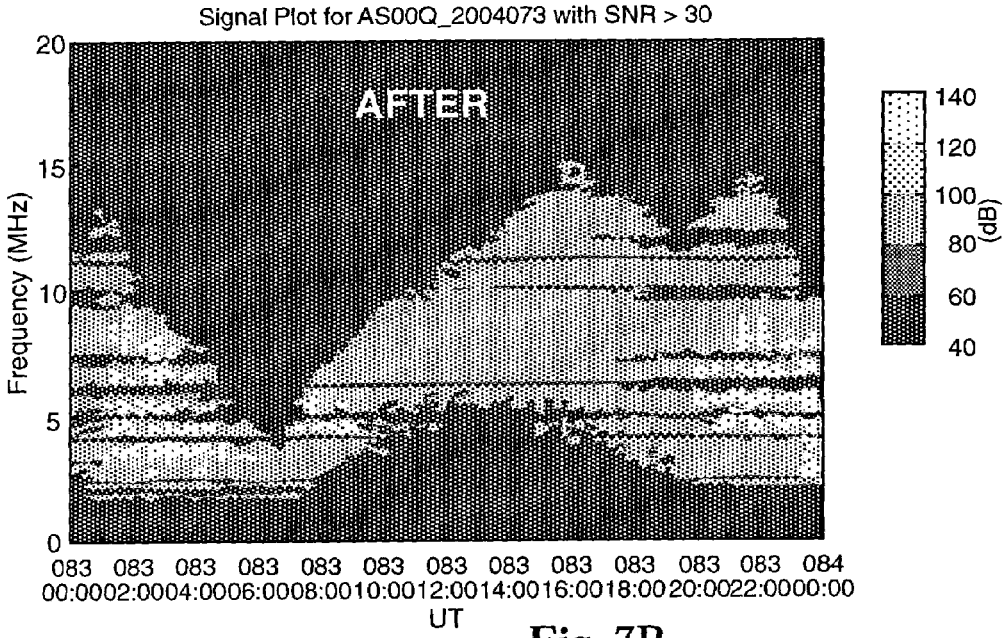
Figure 8:
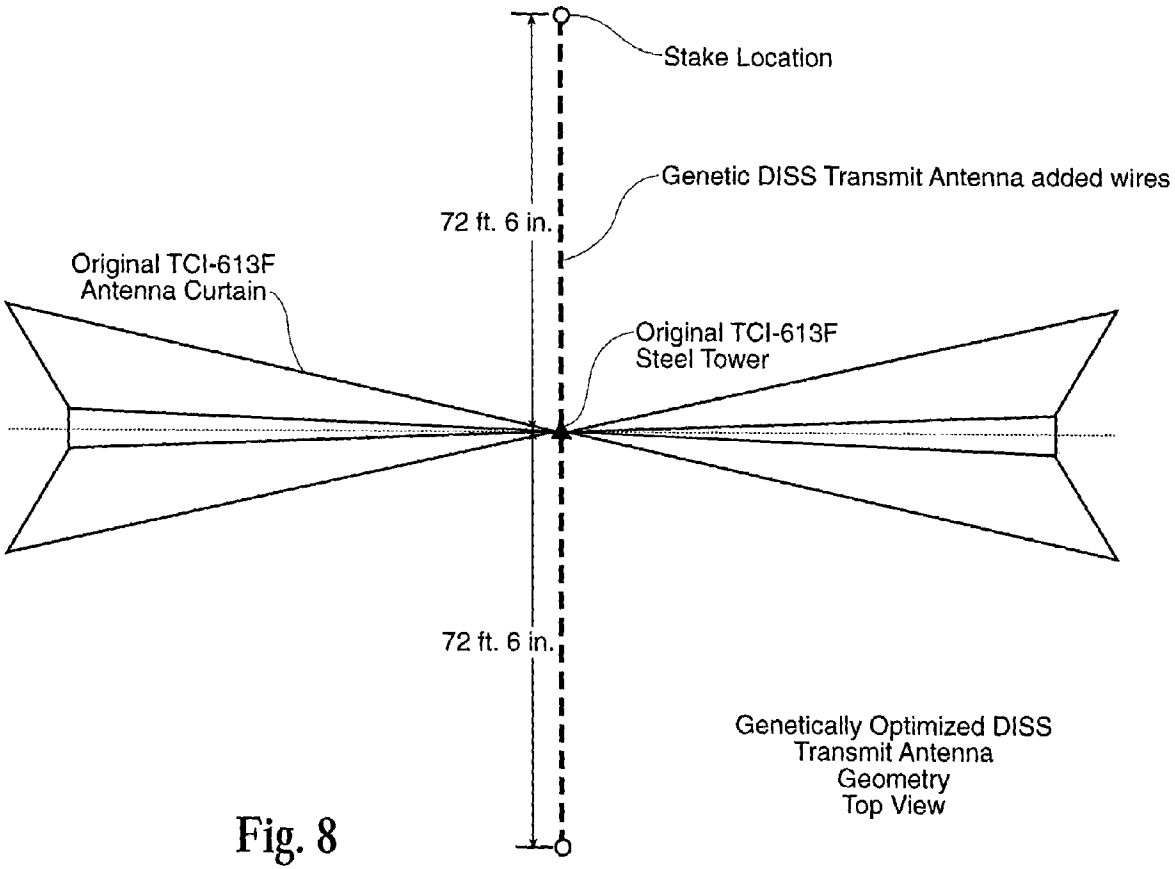
Figure 9:
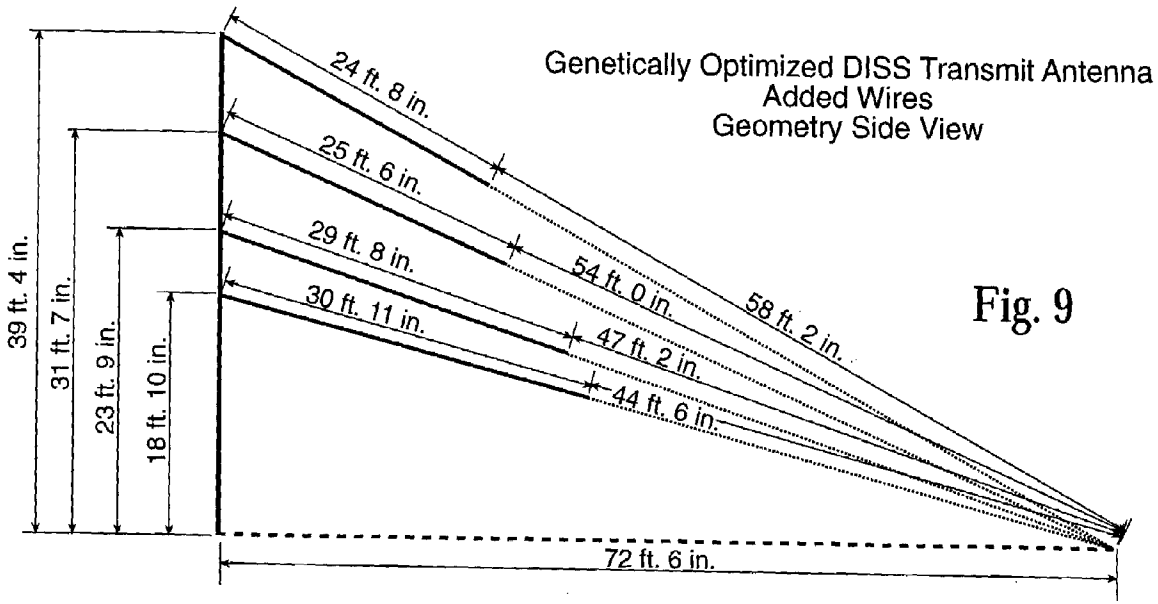
Figure 10:
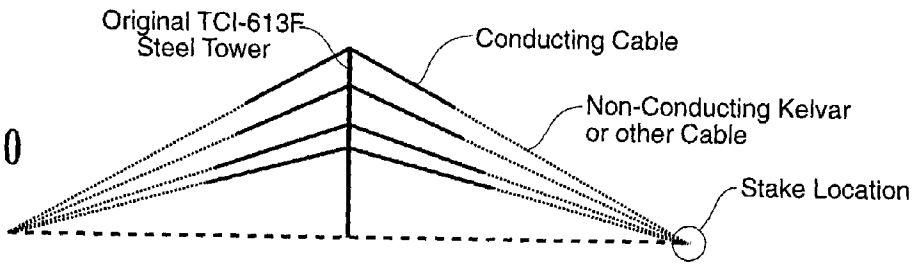
Figure 11:
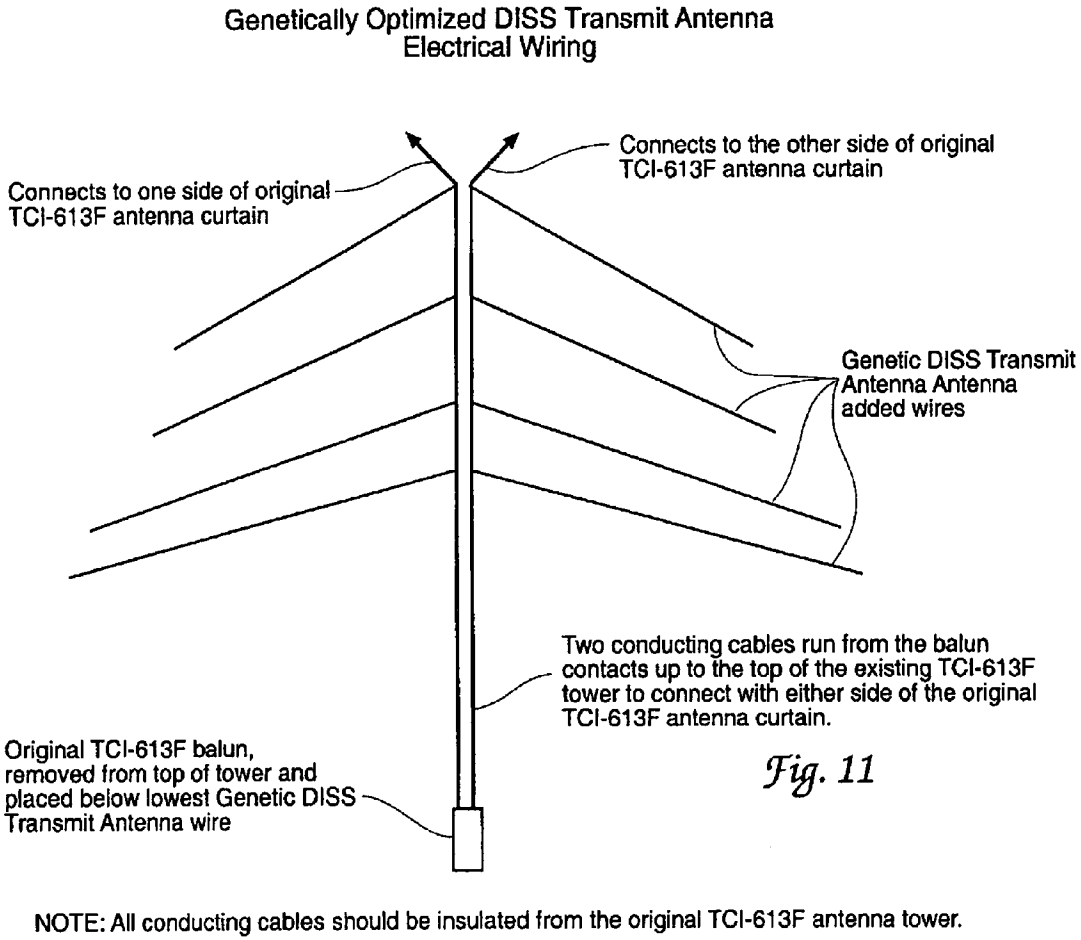
FIG. 11 is a view of the genetically optimized DISS transmit antenna electrical wiring of the present invention.

In operation, the antenna's electrical performance was superb, with improvement at almost all measured frequencies (FIG. 6A), with only a minor increase in VSWR (FIG. 6B). As a result, DISS echoes off of the ionosphere became much stronger and filled in due to the increased performance. The error associated with measuring the critical frequency of the ionosphere (foF2), the primary mission requirement for the DISS, decreased from 16% to 1.6%. This brought the system well inside the 5% error levels expected by the DoD.

The improved performance of the DISS due to genetic algorithm optimization has both further proven the effectiveness of the GA search technique in a real-world application and led to better characterization of the ionospheric environment over Ascension Island, and soon throughout the DISS network, providing clear gains to the warfighter.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A genetically optimized DISS transmit antenna comprising:

a 39'4" TCI-613F steel antenna tower with a base, top bearing plate and balanced/unbalanced transformer;

a TCI-613F radiating antenna curtain attached to the top of the antenna tower;

a pair of cable stakes located about 72 feet from the base of the steel antenna tower at locations perpendicular to the radiating antenna curtain;

a first pair of conducting cables each having a top end attached near the top of the antenna tower, and each being connected by a non-conducting cable to one of the cable stakes;

a second, third, and fourth pair of conducting cables each having a top end connected to the antenna tower and a bottom end connected to one of the cable stakes;

moving of the balanced/unbalanced transformer from the steel antenna tower's top bearing plate to a location below the lowest pair of conducting cables;

a pair of conducting cables running up the steel antenna tower that connect each side of each conducting cable pair and the original TCI-613F radiating curtain to the balanced/unbalanced transformer in its new location.

* * * * *